US008009137B2

(12) United States Patent
Heo

(10) Patent No.: US 8,009,137 B2
(45) Date of Patent: Aug. 30, 2011

(54) IMAGE DISPLAY APPARATUS AND METHOD OF CONTROLLING OVER-CURRENT THEREFOR

(75) Inventor: Jae-cheol Heo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1012 days.

(21) Appl. No.: 11/859,192

(22) Filed: Sep. 21, 2007

(65) Prior Publication Data

US 2008/0203941 A1 Aug. 28, 2008

(30) Foreign Application Priority Data

Feb. 27, 2007 (KR) ..... 10-2007-0019619

(51) Int. Cl.
*G09G 3/36* (2006.01)

(52) U.S. Cl. ..... 345/102

(58) Field of Classification Search ..... 345/102, 345/87, 84, 55, 30; 315/291; 361/1
See application file for complete search history.

(56) References Cited

U.S. PATENT DOCUMENTS

| | | | | |
|---|---|---|---|---|
| 5,463,287 | A | 10/1995 | Kurihara et al. | |
| 5,485,059 | A | 1/1996 | Yamashita et al. | |
| 6,127,789 | A | 10/2000 | Ishizuka et al. | |
| 6,825,828 | B2 * | 11/2004 | Burke et al. | 345/101 |
| 7,525,256 | B2 * | 4/2009 | Ribarich et al. | 315/209 R |
| 7,569,996 | B2 * | 8/2009 | Holmes et al. | 315/291 |
| 2002/0109467 | A1 | 8/2002 | Ito et al. | |
| 2003/0011320 | A1 | 1/2003 | Okamoto et al. | |
| 2006/0028151 | A1 | 2/2006 | Suzuki et al. | |
| 2007/0235012 | A1 * | 10/2007 | Lam | 123/633 |

FOREIGN PATENT DOCUMENTS

| | | | |
|---|---|---|---|
| JP | 5-22620 | A | 1/1993 |
| JP | 6-6628 | A | 1/1994 |
| JP | 9-322012 | A | 12/1997 |
| JP | 10-70693 | A | 3/1998 |
| JP | 2003-319197 | A | 11/2003 |
| JP | 2004-364073 | A | 12/2004 |
| WO | 00/40061 | A | 7/2000 |

* cited by examiner

*Primary Examiner* — Richard Hjerpe
*Assistant Examiner* — Jeffrey Parker
(74) *Attorney, Agent, or Firm* — Sughrue Mion, PLLC

(57) ABSTRACT

An image display apparatus includes: a lighting unit which includes a lamp unit, and illuminates light onto a display screen; a power supply unit which supplies electric power to drive the lamp unit in the lighting unit; a main circuit unit which outputs a brightness control signal to control brightness of the lighting unit, and controls the power supply unit; and a constant voltage generator which is provided between the main circuit unit and the power supply unit, and controls magnitude of the brightness control signal which is output from the main circuit unit, to generate a constant voltage, wherein, by detecting over-current flowing in the lamp unit, the main circuit unit outputs the brightness control signal to apply a corresponding voltage to the lamp unit according to a form of the over-current, or activates the constant voltage generator so that the brightness control signal can be controlled by the constant voltage generator.

17 Claims, 5 Drawing Sheets

IMAGE DISPLAY APPARATUS AND METHOD OF CONTROLLING OVER-CURRENT THEREFOR

CROSS-REFERENCE TO RELATED APPLICATIONS

This application claims the benefit of Korean Patent Application No. 10-2007-0019619, filed on Feb. 27, 2007 in the Korean Intellectual Property Office, the disclosure of which is incorporated herein by reference.

BACKGROUND OF THE INVENTION

1. Field of the Invention

Apparatuses and methods consistent with the present invention relate to an image display apparatus, and more particularly, to controlling over-current in an image display apparatus, in which an operation of a main circuit unit can be prevented from being interrupted due to an unnecessary power cutoff or electric current limit which may be caused by a sensitive operation of an over-current protection circuit.

2. Description of the Related Art

FIG. 1 is a block diagram schematically showing a configuration of a related art image display apparatus.

Referring to FIG. 1, a related art image display apparatus (for example, a liquid crystal display (LCD) television (TV)) includes a lighting unit 130 which includes a lamp unit and illuminates light onto a display screen, a power supply unit 120 which supplies electric power to drive the lamp unit of the lighting unit 130, and a main circuit unit 110 which outputs a brightness control signal to control brightness of the lighting unit 130, and controls the power supply unit 120.

In the related art image display apparatus, electric current or voltage supplied from the power supply unit 120 to the lamp unit of the lighting unit 130 is detected. If the detected electric current or voltage is abnormal, a protection circuit (not shown) is made to operate. In the case that the protection circuit includes only a detection circuit which performs a detection operation in proportion to the electric current, even the instantaneous electric current which is excessively applied by an abnormal oscillation which may occur because of the low ambient temperature is recognized as an over-current even if it is not the electric current which can destruct an actual circuit.

Further, in the case that an abnormal oscillation operating frequency is very fast, the protection circuit is made to operate without being reset via a recharging procedure even by a charge and discharge timing operation. Also, an abnormal brightness control signal is output by fault of a brightness control circuit (not shown) in the main circuit unit 110 to cause the power supply unit 120 to supply over-current to the lamp unit. Even in this case, the protection circuit operates to control a cutoff operation of electric power or a restricting operation of electric current. As a result, the operation of the main circuit unit 110 may be unnecessarily interrupted.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides an image display apparatus and a method of controlling over-current in the image display apparatus, in which an operation of a main circuit can be prevented from being interrupted due to an unnecessary power cutoff or electric current limit which may be caused by a sensitive operation of an over-current protection circuit.

According to an aspect of the present invention, there is provided an image display apparatus comprising: a lighting unit which includes a lamp unit, and illuminates light onto a display screen; a power supply unit which supplies electric power to drive the lamp unit in the lighting unit; a main circuit unit which outputs a brightness control signal to control brightness of the lighting unit, and controls the power supply unit; and a constant voltage generator which is provided between the main circuit unit and the power supply unit, and controls magnitude of the brightness control signal which is output from the main circuit unit, to generate a constant voltage, wherein, by detecting over-current flowing in the lamp unit, the main circuit unit outputs the brightness control signal to apply a corresponding voltage to the lamp unit according to a form of the over-current, or activates the constant voltage generator so that the brightness control signal can be controlled by the constant voltage generator.

The constant voltage generator may comprise a plurality of unit circuits which are connected in parallel with one another, and the unit circuit includes a diode and an on/off switch which is connected in series with the diode.

The main circuit unit may receive feedback signals corresponding to an electric current and a voltage which are supplied from the power supply unit to the lamp unit, to detect an over-current flowing in the lamp unit.

The main circuit unit may receive a feedback signal corresponding to the voltage which is applied to the lamp unit for a given time and determines whether the over-current flowing in the lamp unit is instantaneous or continuous, if the feedback signal corresponding to the electric current which is supplied to the lamp unit is in a low state.

The main circuit unit may judge whether the over-current is instantaneous or continuous, and then outputs the brightness control signal to apply a corresponding voltage to the lamp unit if the over-current is instantaneous, and makes the constant voltage generator operate so that the brightness control signal can be controlled by the constant voltage generator if the over-current is continuous.

The main circuit unit may comprise a memory, and records occurrence of fault of a brightness control circuit, which outputs the brightness control signal, in the memory if the over-current is continuous.

According to another aspect of the present invention, there is provided an over-current control method in an image display apparatus, the over-current control method comprising: detecting an over-current flowing in a lamp unit; determining whether the over-current is instantaneous or continuous; and outputting the brightness control signal to apply a corresponding voltage to the lamp unit if the over-current is instantaneous, and making a constant voltage generator operate so that the brightness control signal can be controlled by the constant voltage generator if the over-current is continuous.

The detecting an over-current may comprise receiving feedback signals corresponding to an electric current and a voltage which are supplied from the power supply unit to the lamp unit, to detect an over-current flowing in the lamp unit.

The determining whether the over-current may be instantaneous or continuous comprises: receiving a feedback signal corresponding to the voltage which is applied to the lamp unit for a given time; and determining whether the over-current flowing in the lamp unit is instantaneous or continuous, when the feedback signal corresponding to the electric current which is supplied to the lamp unit is in a low state.

The making the constant voltage generator may operate comprises: recording occurrence of fault of a brightness control circuit, which outputs the brightness control signal, in a memory and cutting off the electric power which is applied from the power supply unit to the lamp unit if the over-current is continuous; and making the constant voltage generator operate so that the brightness control signal can be controlled by the constant voltage generator at the time of re-start.

BRIEF DESCRIPTION OF THE DRAWINGS

The above and/or other aspects of the present invention will become apparent and more readily appreciated from the following description of the exemplary embodiments, taken in conjunction with the accompanying drawings in which.

DETAILED DESCRIPTION OF THE EXEMPLARY EMBODIMENTS

Figure 1:
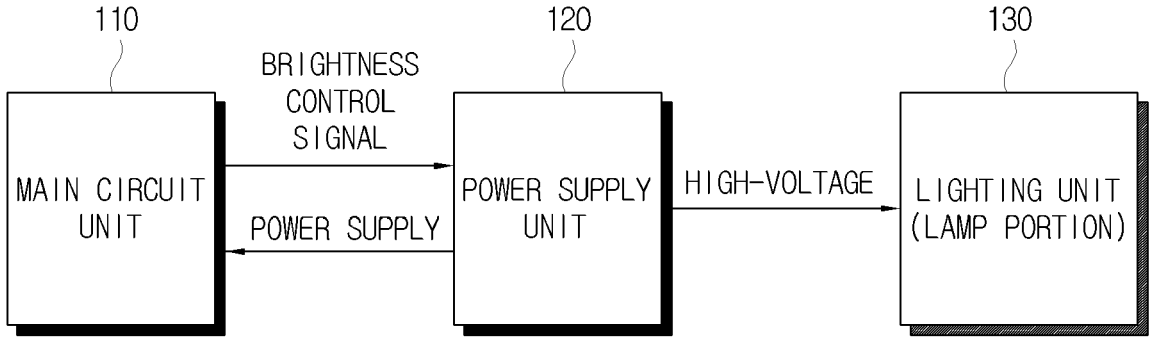
FIG. 1 (RELATED ART)
FIG. 1 is a block diagram illustrating a configuration of a related art image display apparatus.

Reference will now be made in detail to exemplary embodiments of the present invention, examples of which are illustrated in the accompanying drawings, wherein like reference numerals refer to like elements throughout. The exemplary embodiments are described below in order to explain the present invention by referring to the figures.

Figure 2:
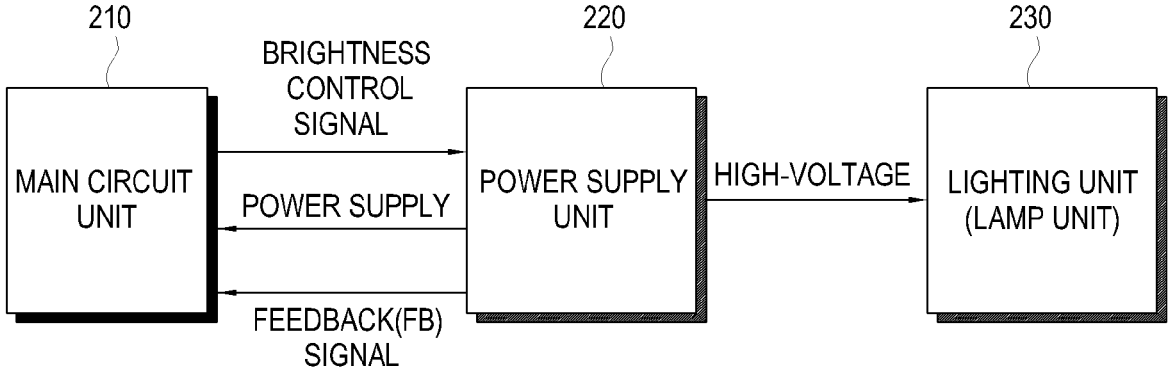
FIG. 2 is a block diagram illustrating an image display apparatus according to an exemplary embodiment of the present invention.
Figure 3:
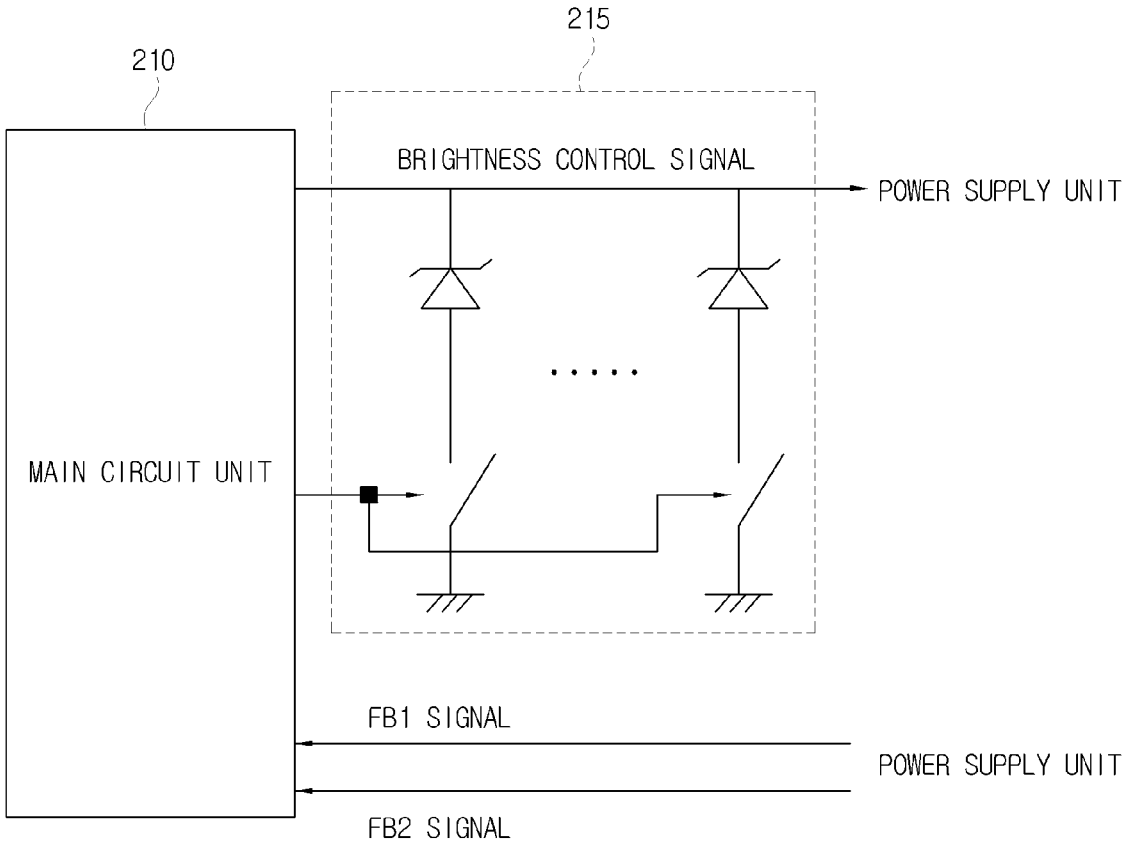
FIG. 3 is a circuit diagram illustrating a constant voltage generator which is provided between a main circuit unit and a power supply unit in an image display apparatus according to an exemplary embodiment of the present invention.

FIG. 2 is a block diagram illustrating an image display apparatus according to an exemplary embodiment of the present invention. FIG. 3 is a circuit diagram illustrating a constant voltage generator which is provided between a main circuit unit and a power supply unit in the image display apparatus according to an exemplary embodiment of the present invention.

Referring to FIGS. 2 and 3, the image display apparatus includes a lighting unit 230, a power supply unit 220, a main circuit unit 210 and a constant voltage generator 215.

The lighting unit 230 includes a lamp unit, and illuminates light to a display screen.

The power supply unit 220 supplies electric power to drive the lamp unit of the lighting unit 230.

The main circuit unit 210 outputs a brightness control signal to control brightness of the lighting unit 230 through an internal brightness control circuit (not shown), and controls the power supply unit 220. The main circuit unit 210 detects over-current flowing in the lamp unit, and outputs the brightness control signal to apply a corresponding voltage to the lamp unit according to a form of the over-current, or activates the constant voltage generator 215 so that the brightness control signal can be controlled by the constant voltage generator 215.

Figure 4:
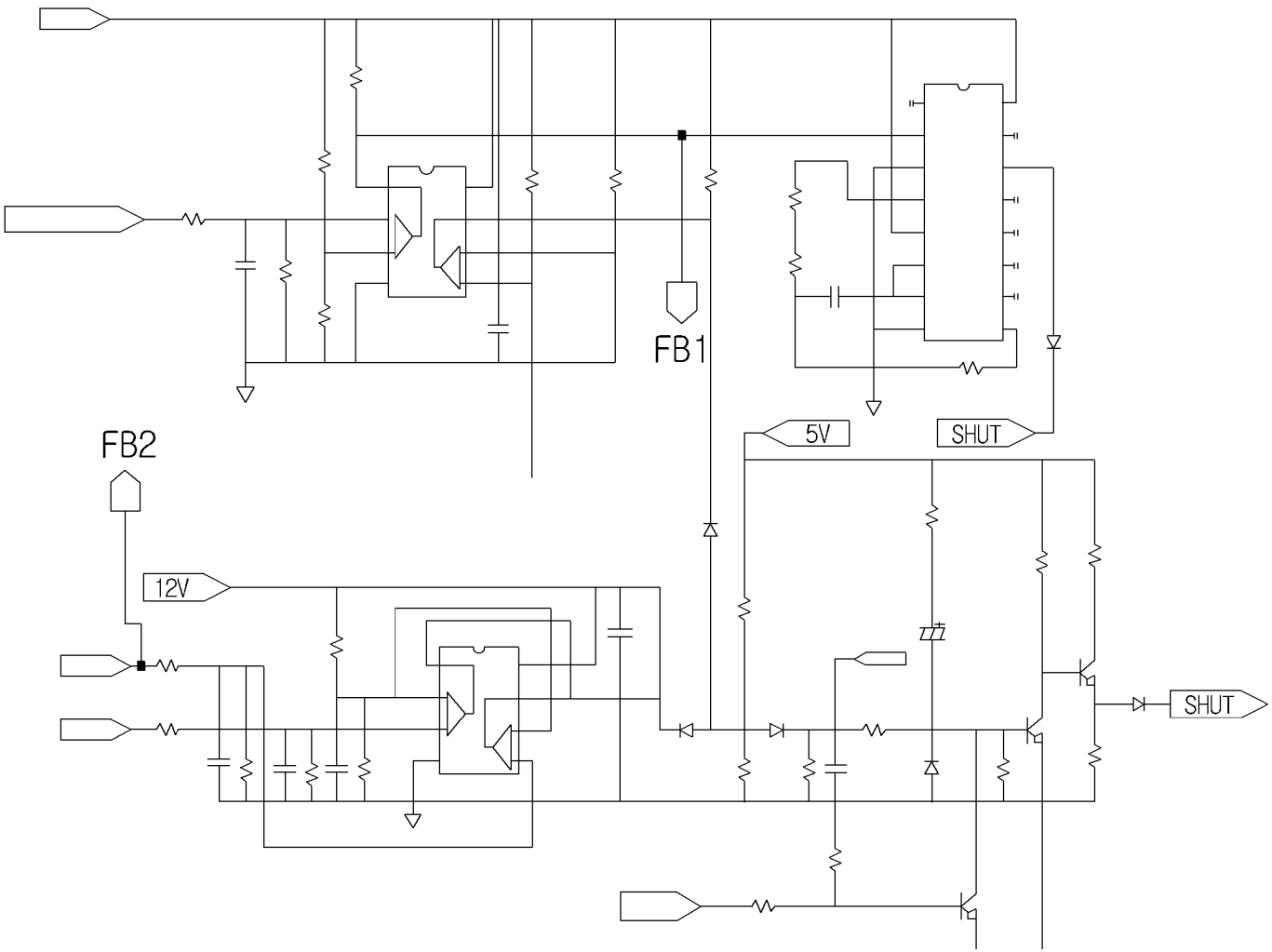
FIG. 4 is a circuit diagram illustrating a configuration of a circuit of a power supply unit in an image display apparatus according to an exemplary embodiment of the present invention and feedback signals which are used for control of an over-current.

The main circuit unit 210 receives a of an electric current feedback signal (FB1 of FIG. 4) and a voltage feedback signal (FB2 of FIG. 4) corresponding to an electric current and a voltage which are supplied from the power supply unit 220 to the lamp unit, to thereby detect an over-current flowing in the lamp unit. In addition, the main circuit unit 210 receives, for a predetermined time, the voltage feedback signal FB2 and determines whether the over-current flowing in the lamp unit is instantaneous or continuous, when the electric current feedback signal FB1 is in a low state. In this case, the main circuit unit 210 outputs the brightness control signal to apply a corresponding voltage to the lamp unit if the over-current is instantaneous, and makes the constant voltage generator 215 operate so that the brightness control signal can be controlled by the constant voltage generator 215 if the over-current is continuous.

In addition, the main circuit unit 210 may further include a memory (for example, an Electrically Erasable and Programmable Read Only Memory (EEPROM)) to record occurrence of fault of a brightness control circuit in the memory if the over-current is continuous.

The constant voltage generator 215 is provided between the main circuit unit 210 and the power supply unit 220, and generates a constant voltage by controlling magnitude of the brightness control signal output from the main circuit unit 210. As described above, the main circuit unit 210 detects over-current flowing in the lamp unit, and outputs the brightness control signal to apply a corresponding voltage to the lamp unit according to a form of the over-current, or activates the constant voltage generator 215 so that the brightness control signal can be controlled by the constant voltage generator 215.

The constant voltage generator 215 includes a plurality of circuit units which are connected in parallel with one another, and each circuit unit includes a diode (for example, a Zener diode) and an on/off switch which is connected in series with the diode.

An over-current control method in an image display apparatus according to an exemplary embodiment of the present invention will be described below with reference to FIG. 5.

Figure 5:
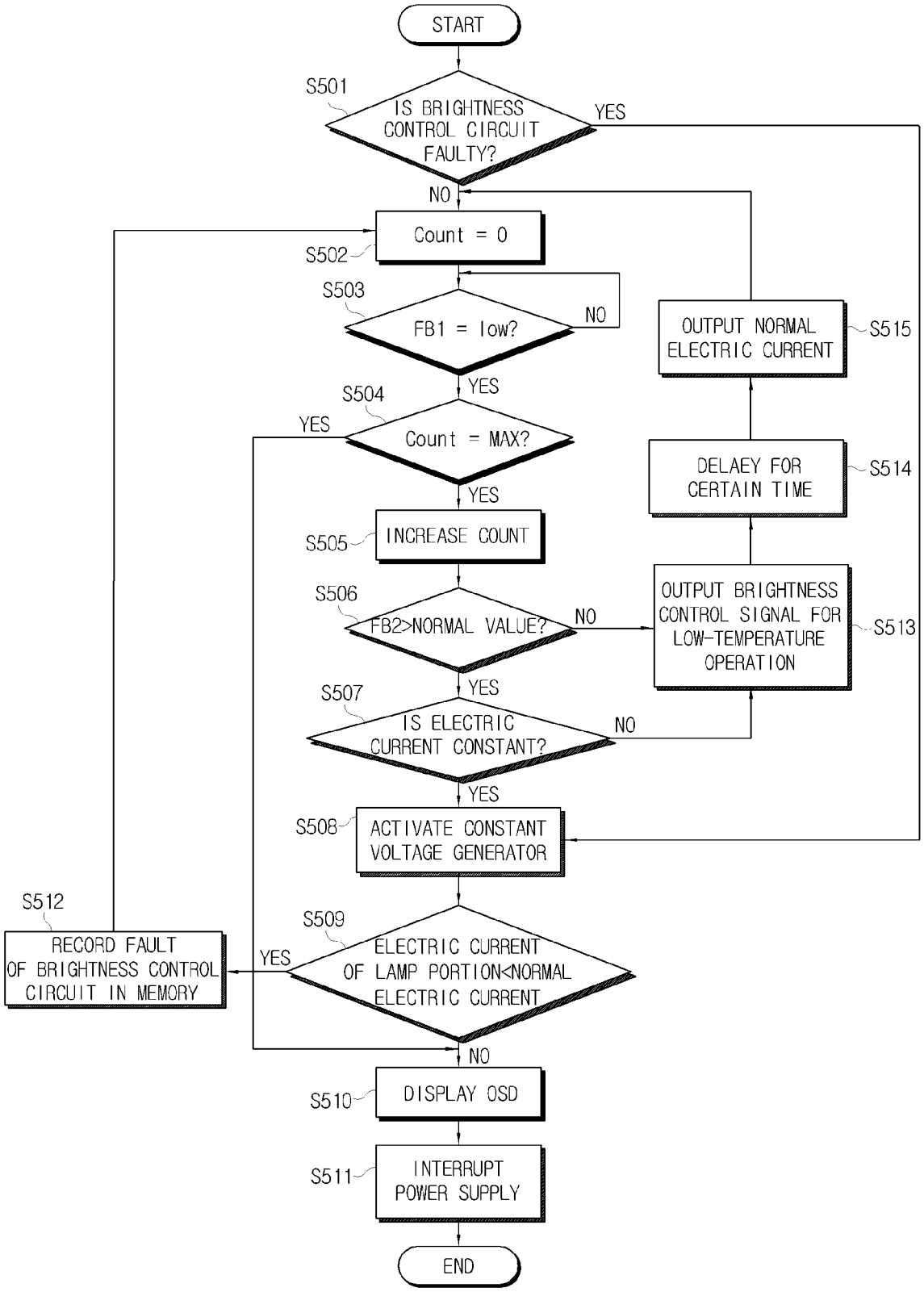
FIG. 5 is a flowchart illustrating an execution procedure of an over-current control method in an image display apparatus according to an exemplary embodiment of the present invention.

FIG. 5 is a flowchart illustrating an execution procedure of an over-current control method in an image display apparatus according to an exemplary embodiment of the present invention. Such flowchart as shown in FIG. 5 represents a software program which is prepared beforehand by the inventor of the present invention and stored in a memory of a main circuit unit.

Referring to FIG. 5, an instantaneous over-current flows in the lamp unit of the lighting unit 230 during operation at a low temperature, and the electric current feedback signal FB1 becomes low state by detection of such an over-current (S501-S503). Here, a microcomputer in the main circuit unit 210 receives the voltage feedback signal FB2 continuously for a given time, and determines whether the over-current is instantaneous or continuous (S504-S506). If the over-current is instantaneous, the main circuit unit 210 determines that the over-current has occurred due to a low-temperature operation, and outputs the brightness control signal for a low-temperature operation (S513), to control the power supply unit 220 to apply a voltage necessary for the low-temperature driving to the lamp unit of the lighting unit. Then, the main circuit unit 210 detects a variation in magnitude of electric current continuously for a given time. Thereafter, if a certain time is passed (S514), a normal current is output (S515).

If the over-current is continuous in operation S506, that is, if it is determined that the over-current has not been caused by the low-temperature operation of the lamp unit when the feedback signal FB1 maintains a low state, the main circuit unit 210 determines that the over-current is due to a problem of a brightness control circuit and makes the constant voltage generator 215 operate so that the brightness control signal can be controlled by the constant voltage generator 215 for limitation of electric current of the lamp unit (S507 and S508). Then, it is determined whether the electric current of the lamp unit is smaller than a normal current (S509). If the electric current is smaller than the normal current, occurrence of fault of the brightness control circuit is recorded in a memory (S512).

If the electric current of the lamp unit does not decrease in spite of controlling the brightness control signal at the normal temperature, it is determined that a problem has occurred in the power supply unit 220. Then, a message is displayed as an On Screen Display (OSD) so that a user can take action in response to the problem of the power supply unit 220 (S510), and the electric power is cut off (S511).

As described above, the present invention determines whether an over-current flowing in a lamp unit is caused by either an environmental problem such as low-temperature or fault of a brightness control circuit in a main circuit unit, and thus performs a proper control so that the image display apparatus can perform a normal operation in each case. Therefore, an operation of a main circuit unit can be prevented from being interrupted due to an unnecessary power cutoff or electric current limit as in the related art. Accordingly, reliability of a product can be increased.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. An image display apparatus comprising:

a lighting unit which includes a lamp unit, and illuminates light onto a display screen;

a power supply unit which supplies electric power to the lighting unit to drive the lamp unit of the lighting unit;

a main circuit unit which outputs a brightness control signal which is provided to the power supply unit to control a brightness of the lighting unit, and controls the power supply unit; and a constant voltage generator which is provided between the main circuit unit and the power supply unit, and controls a magnitude of the brightness control signal which is output from the main circuit unit, to generate a constant voltage, wherein, upon detecting an over-current flowing in the lamp unit, the main circuit unit determines whether the detected over-current is an instantaneous over-current or a continuous over-current, and if the main circuit determines that the detected over-current is the instantaneous over-current, the main circuit outputs the brightness control signal to apply a corresponding voltage to the lamp unit according to a form of the over-current, and if the main circuit determines that the detected over-current is the continuous over-current, the main circuit activates the constant voltage generator so that the brightness control signal is controlled by the constant voltage generator.

2. The image display apparatus according to claim 1, wherein the constant voltage generator comprises a plurality of circuit units which are connected in parallel with one another, and each unit circuit includes a diode and an on/off switch which is connected in series with the diode.

3. The image display apparatus according to claim 1, wherein the main circuit unit receives feedback signals corresponding to an electric current and a voltage which are supplied from the power supply unit to the lamp unit, to detect the over-current flowing in the lamp unit.

4. The image display apparatus according to claim 3, wherein, if the feedback signal corresponding to the electric current which is supplied to the lamp unit is in a low state, indicating that the over-current has occurred, the main circuit unit receives the feedback signal corresponding to the voltage which is applied to the lamp unit for a given time and determines whether the over-current flowing in the lamp unit is the instantaneous over-current or the continuous over-current.

5. The image display apparatus according to claim 4, wherein the main circuit unit records an occurrence of a fault if it is determined that the over-current is continuous.

6. The image display apparatus according to claim 1, wherein the main circuit determines whether the detected over-current is the instantaneous over-current or the continuous over-current by monitoring the over-current for a given time.

7. The image display apparatus according to claim 6, wherein the detected over-current is the continuous over-current if the detected over-current is constant for the given time and the detected over-current is the instantaneous over-current if the detected over-current is not constant for the given time.

8. The image display apparatus according to claim 1, wherein the constant voltage generator is inactive until the continuous over-current is detected and the main circuit activates the constant voltage generator.

9. The image display apparatus according to claim 1, wherein the constant voltage generation is activated only in response to a detection of the continuous over-current.

10. An over-current control method in an image display apparatus, the over-current control method comprising:

detecting an over-current flowing in a lamp unit which illuminates light onto a display screen;

determining whether the detected over-current is an instantaneous over-current or a continuous over-current; and if the detected over-current is determined to be the instantaneous over-current, outputting a brightness control signal to apply a corresponding voltage to the lamp unit, and if the detected over-current is determined to be the continuous over-current, activating a constant voltage generator to operate so that a magnitude of the brightness control signal is controlled by the constant voltage generator.

11. The over-current control method of claim 10, wherein the detecting the over-current comprises receiving feedback signals corresponding to an electric current and a voltage which are supplied from a power supply unit to the lamp unit, to detect the over-current flowing in the lamp unit.

12. The over-current control method of claim 11, wherein the determining whether the detected over-current is the instantaneous over-current or the continuous over-current comprises:

receiving the feedback signal corresponding to the voltage which is applied to the lamp unit for a given time; and determining whether the detected over-current flowing in the lamp unit is the instantaneous over-current or the continuous over-current, if the feedback signal corresponding to the electric current which is supplied to the lamp unit is in a low state which indicates that the over-current has occurred.

13. The over-current control method of claim 10, wherein the making the constant voltage generator operate comprises:

recording occurrence of a fault and cutting off electric power which is applied from a power supply unit to the lamp unit if it is determined that the detected over-current is the continuous over-current; and making the constant voltage generator operate so that the brightness control signal is controlled by the constant voltage generator at a time of re-start.

14. The over-current control method of claim 10, wherein the determining whether the detected over-current is the instantaneous over-current or the continuous over-current comprises monitoring the detected over-current for a given time.

15. The over-current control method of claim 14, wherein the detected over-current is the continuous over-current if the detected over-current is constant for the given time and the detected over-current is the instantaneous over-current if the detected over-current is not constant for the given time.

16. The over-current control method of claim 10, wherein the constant voltage generator is inactive until the continuous over-current is detected.

17. The over-current control method of claim 10, wherein the constant voltage generation is activated only in response to a detection of the continuous over-current.

* * * * *